US005533474A

United States Patent [19]

Hufendiek et al.

[11] Patent Number: 5,533,474

[45] Date of Patent: Jul. 9, 1996

[54] LUBRICATING-OIL DEVICE FOR AN INTERNAL COMBUSTION ENGINE

[75] Inventors: Ernst-Wilhelm Hufendiek, Stuttgart; Walter Kerschbaum, Fellbach; Johannes Werner, Hamburg, all of Germany

[73] Assignee: Mercedes-Benz AG, Stuttgart, Germany

[21] Appl. No.: 372,788

[22] Filed: Jan. 13, 1995

[30] Foreign Application Priority Data

Jan. 14, 1994 [DE] Germany ..... 44 00 953.4

[51] Int. Cl.[6] ..... F01M 11/02

[52] U.S. Cl. ..... 123/196 AB; 123/195 C

[58] Field of Search ..... 123/196 R, 195 C, 123/196 AB

[56] References Cited

U.S. PATENT DOCUMENTS

| | | | |
|---|---|---|---|
| 4,883,031 | 11/1989 | Ampferer et al. | 123/195 C |
| 4,977,870 | 12/1990 | Hashimoto et al. | 123/195 C |
| 5,094,201 | 3/1992 | Bedi . | |
| 5,152,264 | 10/1992 | Evans | 123/195 C |

FOREIGN PATENT DOCUMENTS

| | | |
|---|---|---|
| 2459295 | 7/1975 | Germany . |
| 2737054 | 3/1979 | Germany . |
| 2951961 | 7/1980 | Germany . |
| 2909047 | 3/1981 | Germany . |
| 3436426 | 5/1985 | Germany . |
| 3701083 | 5/1988 | Germany . |
| 4029408 | 3/1992 | Germany . |

OTHER PUBLICATIONS

"Die neuen Mercedes–Benz Nutzfahrzeugmotoren OM 441, OM 441 LA, OM 442, OM 442 A, OM 442 LA", Printed Co. Publ. Sep. 1989.

*Primary Examiner*—Erick R. Solis
*Attorney, Agent, or Firm*—Klaus J. Bach

[57] ABSTRACT

A lubricating-oil device for an internal combustion engine having two cylinder banks and a lubricating oil circuit with a main oil passage in each cylinder bank comprises a casing cover which is mounted on the front of the engine and includes a heat exchanger and an oil filter with all required communication passages for the oil and a supply passage which interconnects the main oil passages in the cylinder banks and which is in communication with the oil filter outlet for concurrently supplying filtered oil from the oil filter to both main oil passages.

5 Claims, 3 Drawing Sheets

LUBRICATING-OIL DEVICE FOR AN INTERNAL COMBUSTION ENGINE

BACKGROUND OF THE INVENTION

The invention relates to a lubricating-oil device for an internal combustion engine with two cylinder banks and a casing cover mounted on the front of the engine and including heat exchanger and oil filter and associated passages for supplying the filtered oil directly to the various oil passages in the engine.

Applicant's company publication "Die neuen Mercedes-Benz Nutzfahrzeugmotoren OM 441, OM 441LA, OM 442, OM 442A, OM 442LA" already discloses such a lubricating-oil device for an internal combustion engine having a lubricating circuit and two cylinder banks, wherein the lubricating circuit comprises per cylinder bank a main oil passage and secondary oil passages leading to lubricating points, and wherein a heat exchanger and an oil filter are arranged in the lubricating circuit. The two main oil passages are interconnected by Y-shaped secondary passages. An outlet opening of the lubricating-oil side of the heat exchanger is connected to an inlet opening of the oil filter and an outlet opening of the oil filter is connected via an oil passage to one of the two main oil passages of the lubricating circuit. The other main oil passage is not connected to the main oil passage and is filled with lubricating oil via the Y-shaped secondary lines.

For general background information, reference is also made to the following publications: German Offenlegungsschrift 4029408, German Patent 3701083, German Offenlegungsschrift 2951961, German Offenlegungsschrift 2909047, German Patent 2737054 and German Auslegeschrift 2459295.

It is the object of the invention to provide a lubricating-oil device which improves the supply of lubricating oil to the lubricating points of the internal combustion engine.

SUMMARY OF THE INVENTION

A lubricating-oil device for an internal combustion engine having two cylinder banks and a lubricating oil circuit with a main oil passage in each cylinder bank comprises a casing cover which is mounted on the front of the engine and includes a heat exchanger and an oil filter with all required communication passages for the oil and a supply passage which interconnects the main oil passages in the cylinder banks and which is in communication with the oil filter outlet for concurrently supplying filtered oil from the oil filter to both main oil passages.

An advantage of the lubricating-oil device according to the invention lies in the fact that, in internal combustion engines having two cylinder banks and one main oil passage in each cylinder bank, the oil quantity and oil pressure of the lubricating oil is considerably improved in particular at the lubricating points (e.g. bearings) furthest away from the feed-in point for the lubricating oil, since the lubricating oil can now be delivered simultaneously into both main oil passages and thus reaches the lubricating points via shorter lubricating-oil flow paths.

A further advantage which results from the arrangement of the lubricating-oil device according to the invention lies in the fact that better emptying of the used lubricating oil from the lubricating circuit is achieved during an oil change, since emptying of the lubricating oil located in the heat exchanger is also effected during draining of the lubricating oil due to the favorable position of the heat exchanger in the lubricating circuit. This draining is further improved if the components and passages in the casing cover are arranged at different levels such that draining is facilitated.

An advantage of the device according to the invention with particular passage arrangements and passage cross-sections can be taken from the fact that the bearing cross-section that can be accommodated by the casing wall, which is subjected to high mechanical loading by the camshaft forces and in which the V-shaped passage parts of the Y-shaped secondary passages run, is enlarged. The cross-sectional reduction of the V-shaped passage parts is Only possible by the simultaneous feeding of the lubricating oil into both main oil lines.

The invention is explained in greater detail in the drawings with reference to an exemplary embodiment.

DESCRIPTION OF A PREFERRED EMBODIMENT

Figure 1:
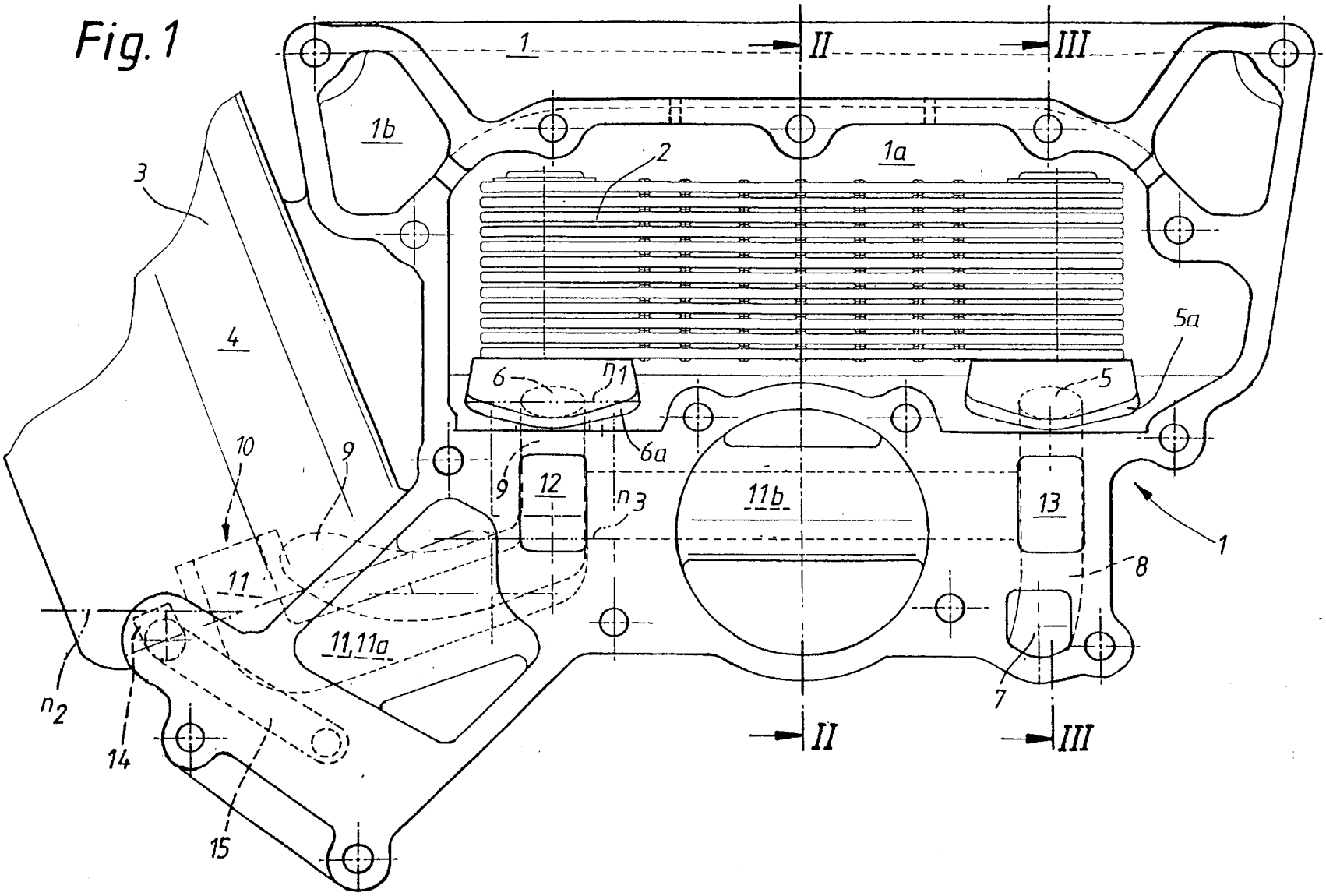
FIG. 1 is a partial representation of a lubricating-oil device according to the invention, having a casing cover which is fastened to the front end of an internal combustion engine having two cylinder banks arranged in a V-shape, and shows the side of the casing cover connected to the internal combustion engine, a heat exchanger being arranged in the casing cover and an oil filter being arranged on the side of the casing cover.

FIG. 1 is a partial representation of a lubricating-oil device having a casing cover 1 which is fastened to an internal combustion engine having two cylinder banks arranged in a V shape. The casing cover 1 accommodates a heat exchanger 2 and is shown from the side of the casing cover 1 which is normally attached to the internal combustion engine.

The casing cover 1 forms spaces 1*a* and 1*b* in which cooling liquid is located, the heat exchanger 2 being arranged in the space 1*a* where it is surrounded on all sides by cooling liquid.

An oil filter 3 having a partially shown oil-filter casing 4 integrally cast on the side of the casing cover 1 is disposed upright outside the casing cover. An oil-filter cartridge (not shown) is located in the oil-filter casing 4.

The heat exchanger 2 has an inlet opening 5 together with flange 5*a* (see FIG. 3) and an outlet opening 6 together with flange 6*a* for the lubricating oil and is screwed at the flanges 5*a* and 6*a* to the casing cover 1.

The lubricating oil passes from an inlet opening 7 of the casing cover 1 via an oil passage 8 to the inlet opening 5 of the heat exchanger 2, flows through the latter to its outlet opening 6 and from there via an oil passage 9 into the oil filter 3. The oil passes from the latter via an opening 10 into an oil passage 11 having oil-passage parts 11*a* and 11*b* to the main oil passages of the internal combustion engine, from which main oil passages secondary lines lead to the individual lubricating points. The two main oil passages running in the longitudinal axis of the internal combustion engine are connected via Y-shaped secondary lines (not shown) which lead to secondary consumers (not shown) such as, for example, crankshaft bearings, camshaft bearings, cylinder heads and piston sprayers.

The oil-passage part 11*a* of the oil passage 11 leads from the oil filter 3 back into the casing cover 1 and is in communication with the oil-passage part 11*b*, which is located in the casing cover 1 and is arranged transversely to the longitudinal axis of the internal combustion engine, two openings 12 and 13 being located in the oil-passage part 11*b* in spaced relationship so as to be in alignment with the two main oil lines of the two cylinder banks. The opening 12 is in communication with the main oil passage of the first cylinder bank and the opening 13 is in communication with the main oil passage of the second cylinder bank.

In the installed state, the oil-filter cartridge closes an oil-discharge valve 14 which is arranged in the bottom area of the oil-filter casing 4 and controls an oil-discharge passage 15 for emptying oil into a crankcase (not shown). The oil-discharge valve 14 is opened automatically when the oil-filter cartridge is removed.

The heat exchanger 2 is arranged on the casing cover in such a way that, in the installed position, a level $n_1$ of the outlet opening 6 lies above a level $n_2$ of the oil-discharge valve 14 in the oil-filter casing 4. Since an oil change is also usually carried out during a change of the oil-filter cartridge, the lubricating oil located in the heat exchanger 2 can thus be completely emptied, inter alia, via the oil-discharge valve 14 in the oil-filter casing 4 into an oil sump (not shown) of the internal combustion engine. As apparent from FIG. 1, the level $n_2$ also lies below a level $n_3$ of the oil-passage part 11*b* so that the latter can also be emptied via the oil-discharge valve 14.

Figure 2:
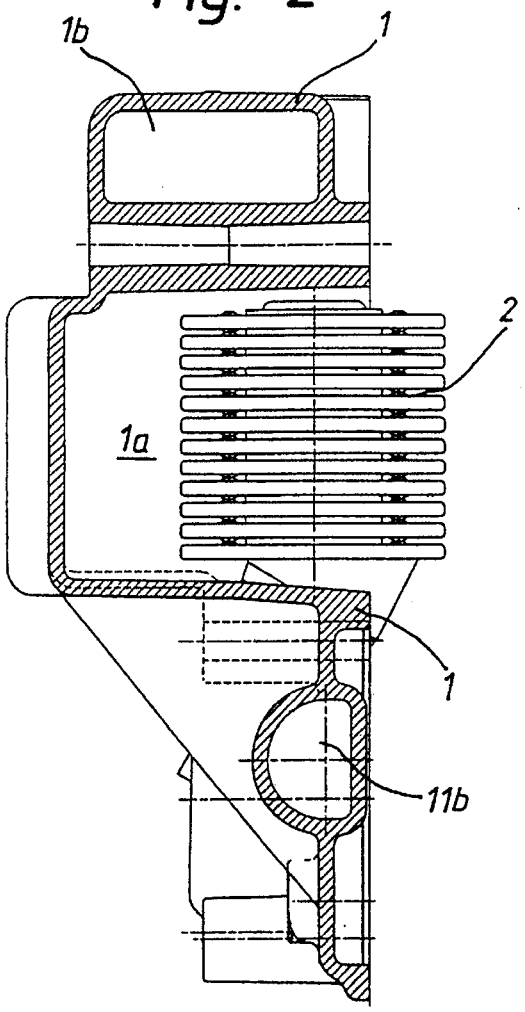
FIG. 2 is a cross-sectional view taken along line II—II of FIG. 1.
Figure 3:
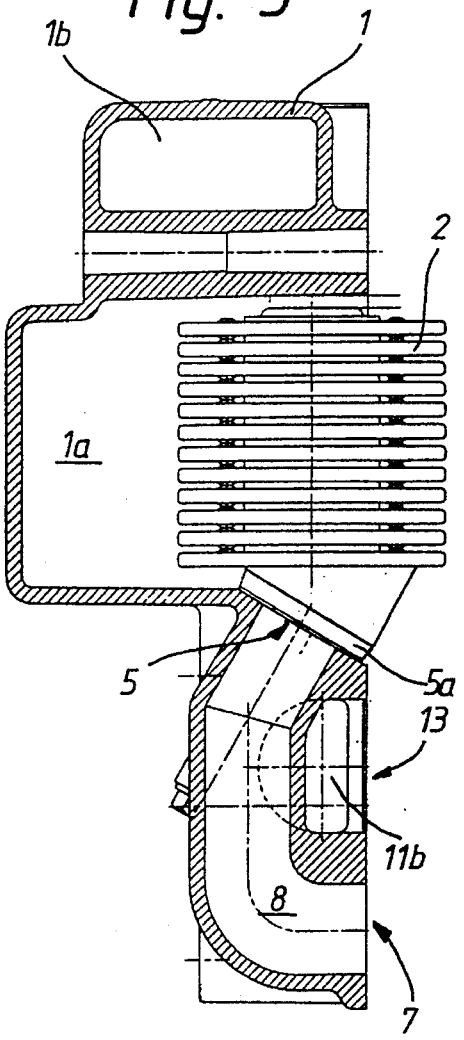
FIG. 3 is a cross-sectional view taken along line III—III of FIG. 1.

A section II—II of FIG. 1 is shown in FIG. 2 and a section III—III of FIG. 1 is shown in FIG. 3. The same components are identified by the same reference numerals.

Figure 4:
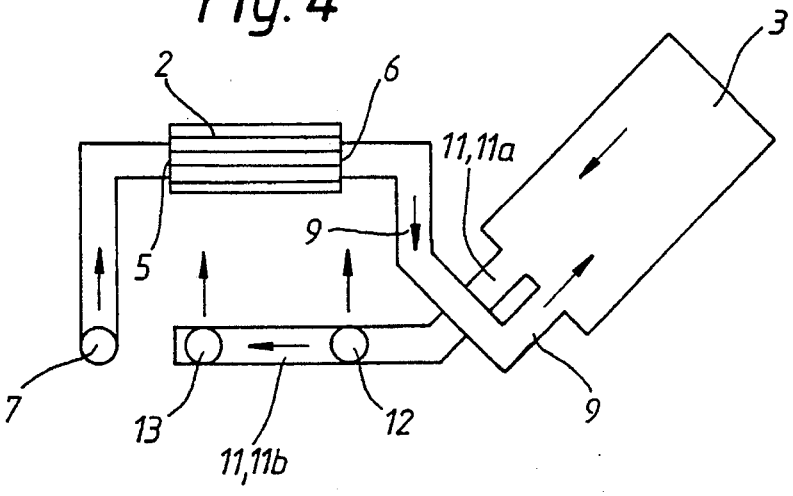
FIG. 4 is a schematic representation of the oil flow arrangement through the heat exchanger, the oil filter and the casing cover according to FIG. 1.

The oil flow through the heat exchanger 2, the oil filter 3 and the oil passage 11 having oil-passage parts 11*a* and 11*b* of the casing cover 1 is schematically shown in FIG. 4. The same parts from FIGS. 1 to 3 are identified by the same reference numerals. The direction of flow of the lubricating oil is shown by arrows .

Figure 5:
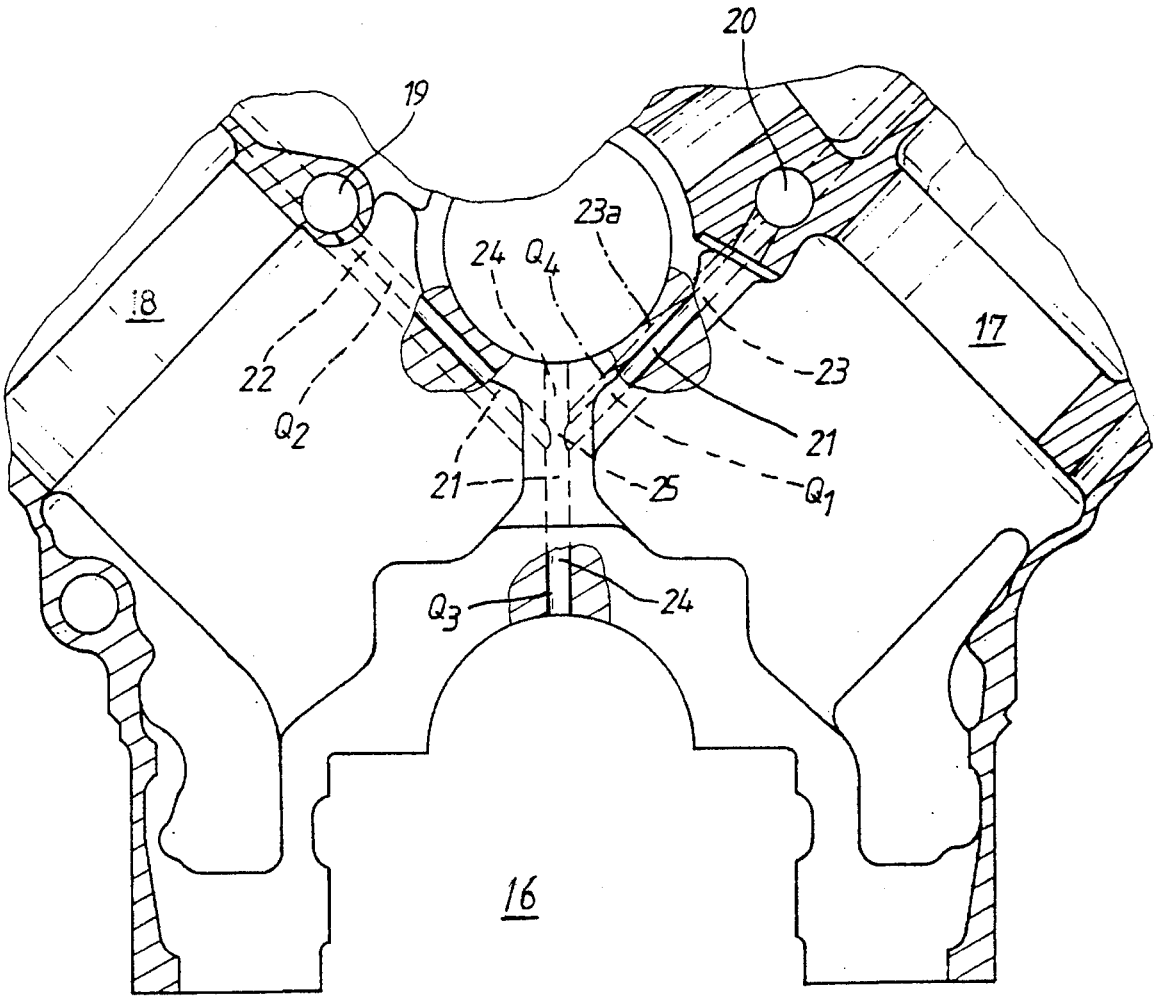
FIG. 5 is a partial schematic representation of a cross-section through the crankcase of the internal combustion engine.

FIG. 5 is a schematic representation of a cross-section, known in principle, of a crankcase 16 of the internal combustion engine having two cylinder banks 17 and 18 arranged in a V-shape and two main oil passages 19 and 20.

The main oil passages 19 and 20 are connected by roughly Y-shaped secondary lines 21 having in each case two line parts 22, 23, arranged in a V-shape and having cross-sections $Q_1$, $Q_2$ (shown by broken lines), and a common line part 24 having a cross-section $Q_3$ together with a confluence area 25 (likewise shown by broken lines). Since the common line part 24 serves to supply lubricating points such as crankshaft and camshaft bearings, the line part 24 extends from the confluence area 25 both towards the top in the direction of the camshaft and towards the bottom in the direction of the crankshaft.

The cross-section $Q_1$, $Q_2$ of each passage part 22 or 23 originating from the main oil passages 19, 20 corresponds to half the cross-section Q3 of the common passage part 24 of the Y-shaped secondary line 21.

Due to the simultaneous feeding of oil, described above, into the two main oil lines 19, 20, the cross-section $Q_1$, $Q_2$ of the line parts 22, 23 arranged in a V-shape can be relatively small since the lubricating oil is forced from the two main oil lines 19, 20 into the line parts 22, 23 and does not flow as hitherto from one main oil passage via a plurality of connecting lines into the other main oil passage.

In a further embodiment of the invention, which is shown by dashed lines in FIG. 5, the feeding of lubricating oil to the passage part 24 is effected only from the main oil passage 20 via one passage part 23*a* having a cross-section $Q_4$, the cross-section $Q_4$ of the passage part 23*a* then corresponding to the cross-section $Q_3$ of the passage part 24.

What is claimed is:

1. A lubricating-oil device for an internal combustion engine having two cylinder banks and a lubricating-oil circuit with at least one main oil passage per cylinder bank and secondary oil passages leading to various engine lubrication points, said lubricating-oil device comprising a casing cover mounted on the front end of said internal combustion engine, a heat exchanger with an oil inlet and outlet disposed in said casing cover, an oil filter disposed on the outside of said casing cover and having an inlet in communication with the outlet of said heat exchanger, an oil supply passage extending in said casing cover transversely to the longitudinal axis of said engine, said oil supply passage being in communication with outlet of said oil filter and having end openings disposed over said main oil passages in said cylinder banks thereby interconnecting said main oil passages in said cylinder banks through said casing cover for supplying lubricating oil simultaneously to both main oil passages.

2. A lubricating-oil device according to claim 1, wherein an oil-filter casing is integrally cast directly on said casing cover close to the outlet opening of the heat exchanger in said casing cover.

3. A lubricating-oil device according to claim 1, wherein said heat exchanger and said oil filter are arranged on the casing cover and said oil filter includes an oil discharge valve disposed in a communication passage leading downwardly to the engine crankcase, said oil filter being arranged in such a way that a level ($n_1$) of the outlet opening of the lubricating-oil side of the heat exchanger is above the level ($n_2$) of said oil-discharge valve in said oil-filter casing.

4. A lubricating-oil device according to claim 1, wherein for the Y-shaped secondary lines which in each case comprise two line parts arranged in a V-shape and joined to a common line part defining a confluence area, a cross-section ($Q_1$, $Q_2$) of each line part extending from the main oil passage is smaller than the cross-section ($Q_3$) of the common passage part of the Y-shaped secondary passage.

5. A lubricating-oil device according to claim 4, wherein a line part leads from one of the main oil passages to the common passage part and has a cross-section ($Q_4$) corresponding to the cross-section ($Q_3$) of the common passage part.

* * * * *